US006641259B1

(12) United States Patent
Kopolow et al.

(10) Patent No.: US 6,641,259 B1
(45) Date of Patent: Nov. 4, 2003

(54) SUBSTRATE FOR COLOR INKJET PRINTING

(75) Inventors: Stephen L. Kopolow, Plainsboro, NJ (US); Drupesh Patel, Lake Hiawatha, NJ (US); Yoon Tae Kwak, Woodcliff Lake, NJ (US); Michael Tallon, Aberdeen, NJ (US); David K. Hood, Basking Ridge, NJ (US); Laurence Senak, Livingston, NJ (US); John M C Kittrick, Jersey City, NJ (US)

(73) Assignee: ISP Investments Inc., Wilmington, DE (US)

( * ) Notice: Subject to any disclaimer, the term of this patent is extended or adjusted under 35 U.S.C. 154(b) by 0 days.

(21) Appl. No.: 10/162,839

(22) Filed: Jun. 5, 2002

(51) Int. Cl.[7] ..... B41J 2/01
(52) U.S. Cl. ..... 347/105; 347/101

(58) Field of Search ..... 347/100, 105, 347/101; 428/195; 346/135.1

(56) References Cited

U.S. PATENT DOCUMENTS 4,585,724 A * 4/1986 Helling et al. ..... 430/213
6,391,995 B2 * 5/2002 Murugan et al. ..... 526/265
6,431,700 B1 * 8/2002 Chen et al. ..... 347/100

* cited by examiner

*Primary Examiner*—Stephen D. Meier
*Assistant Examiner*—Manish Shah
(74) *Attorney, Agent, or Firm*—Walter Katz; William J. Davis; Marilyn J. Maue

(57) ABSTRACT

A method of color inkjet printing on a substrate coated with a substantially colorless, 90–10 to 30–70, wt/wt, copolymer of vinyl pyrrolidone and vinyl imidazole, by inkjet printing dye images on the thus-coated substrate, characterized in that the dye images obtained exhibit excellent light fastness.

5 Claims, No Drawings

SUBSTRATE FOR COLOR INKJET PRINTING

BACKGROUND OF THE INVENTION

1. Field of the Invention

This invention relates to color inkjet recording films, and, more particularly to color-receptive films coated with substantially colorless copolymers of vinyl pyrrolidone (VP) and vinyl imidazole VI), characterized in that the color images obtained exhibit excellent light fastness.

2. Description of the Prior Art

The advent of color inkjet printing has been instrumental in fueling the print-on-demand revolution and has also created a number of challenges. Often, the surface of the desired media does not possess the necessary properties for accepting the ink-jet ink. This results in long dry times and/or a poor ink-jet image. It has long been recognized that a surface treatment or media coating plays a critical role in the final print quality. Numerous media coatings are known in the art. They may contain any number of components and often consist of more than one layer. These ink-receptive coatings generally contain at least one hydrophilic polymer; often poly(vinylpyrrolidone) (PVP). PVP brings many benefits to properly formulated media coatings including rapid ink dry time, excellent print quality, highly resolved circular dots, and high, uniform optical density. Furthermore, copolymers of vinylpyrrolidone (VP) along with other suitable comonomers, such as dimethylaminoethyl methacrylamide (DMAPMA), acrylic acid, or vinyl acetate, have been used separately or in conjunction with PVP, to further optimize performance. However, it is desired also to provide long-term, excellent water-resistant qualities for such films.

Commercial VP/VI copolymers e.g. BASF's LUVITEC® (90:10 to 30:70 wt/wt) are yellow in color. When coated onto a white polyester film for digital printing inkjet (DPI) applications, these copolymers leave a yellow cast on the printed film.

Accordingly, it is an object of this invention to provide an improved VP/VI copolymer for such DPI applications so that the printed films exhibit excellent light fastness.

These and other objects of the invention will be made apparent from the following description.

SUMMARY OF THE INVENTION

What is described herein is a method of digital inkjet printing in which a substrate is coated with a substantially colorless, 90–10 to 30–70, wt/wt, copolymer of vinyl pyrrolidone (VP) and vinyl imidazole (VI) uncrosslinked or crosslinked, followed by inkjet printing dye images on the thus-coated substrate, characterized in that the dye images obtained exhibit excellent light fastness.

Preferably the copolymer has an APHA color rating of <125, most preferably <50, which indicates that it is substantially colorless; and the copolymer has a VP/VI monomer weight ratio of about 50/50; and still more preferably, the light fastness of dye images obtained on the coated film extends for at least one year.

DETAILED DESCRIPTION OF THE INVENTION

Commercial VI monomer has an APHA color rating of 3850; accordingly, copolymers of VP/VI (50/50 wt/wt) in water have an APHA color rating of only 231.6. DPI applications using such polymers for coating substrates require an APHA color of the coating polymers of <125 so that the dye image will be unaffected by the inherent color of the coating itself. Most particularly, high APHA color rating copolymers are observed to leave a color cast on the printed film.

EXAMPLE

Thus said, in accordance with the invention, crude VI was flash distilled under vacuum to a color level of only 12.4. Thereby, copolymers of this purified VI and VP (e.g. 50/50 wt/wt) in water were prepared with an APHA color rating of only 46.6. In DPI applications, this purified copolymer of 50/50 wt/wt VP/VI gave excellent light fastness. A comparative film with commercial VP/VI showed unacceptable light fastness.

While the invention has been described with particular reference to certain embodiments thereof, it will be understood that changes and modifications may be made which are within the skill of the art. Accordingly, it is intended to be bound only by the following claims, in which:

What is claimed is:

1. A method of digital inkjet printing light fast dye images on a substrate which comprises coating said substrate with an ink-receptive layer consisting essentially of a substantially colorless, 90–10 to 30–70, wt/wt, uncrosslinked or crosslinked copolymer of vinyl pyrrolidone and vinyl imidazole, and-inkjet printing said dye images-on-said thus-coated-substrate.

2. A method according to claim 1 wherein said copolymer has an APHA color rating of <125.

3. A method according to claim 1 wherein said copolymer has an APHA color rating of <50.

4. A method according to claim 1 wherein said copolymer has a weight ratio of 50/50.

5. A method according to claim 1 wherein said substantially colorless copolymer is made by flash distilling crude vinyl imidazole under vacuum, and copolymerizing the thus-purified vinyl imidazole with vinyl pyrrolidone.

* * * * *